US006456185B1

(12) United States Patent
Yu

(10) Patent No.: US 6,456,185 B1
(45) Date of Patent: Sep. 24, 2002

(54) PUSH-BUTTON SWITCH WITH OVERLOAD PROTECTION

(76) Inventor: Tsung-Mou Yu, No. 4, Alley 2, Lane 23, Sec. 3, Pa-Te Road, Pan-Chiao City, Taipei Hsien (TW)

( * ) Notice: Subject to any disclaimer, the term of this patent is extended or adjusted under 35 U.S.C. 154(b) by 172 days.

(21) Appl. No.: 09/602,965

(22) Filed: Jun. 23, 2000

(30) Foreign Application Priority Data

Jun. 24, 1999 (TW) ..... 88210454 U

(51) Int. Cl.[7] ..... H01H 71/16; H01H 9/00
(52) U.S. Cl. ..... 337/37; 200/314; 337/66
(58) Field of Search ..... 200/18, 520–565, 200/314; 337/14, 37, 52, 53, 62–66, 70–85, 334–353

(56) References Cited

U.S. PATENT DOCUMENTS 4,661,667 A 4/1987 Sorimachi et al. ..... 200/314
4,704,594 A 11/1987 Krasser ..... 337/66
4,931,762 A 6/1990 Fierro ..... 337/66
4,937,548 A 6/1990 Sdunek ..... 337/70
5,223,813 A 6/1993 Cambreleng et al. ..... 337/66
5,451,729 A 9/1995 Onderka et al. ..... 200/18
5,786,742 A 7/1998 Yin ..... 337/66

*Primary Examiner*—J. R. Scott

(57) ABSTRACT

A push button switch with overload protection is disclosed. The switch comprises a housing, a conducting unit, and an acting unit The conducting unit comprises a normal-opened first conducting leaf and a thermally deformed bimetallic sheet. The bimetallic sheet is of a U-shape having a returning end and an opening end. The returning end can be deformed to an overload position from a normal position in response to overload, and is provided with an enabling rest for supporting a tail of a rocking lever of the actuating unit so as to cause a depression of a nose of the rocking lever on the first conducting leaf, which forces the fist conducting leaf into a closed position, or to release said depression to permit the fit conducting leaf to return to its open position.

9 Claims, 13 Drawing Sheets

PUSH-BUTTON SWITCH WITH OVERLOAD PROTECTION

BACKGROUND OF THE INVENTION

The present invention relates to a push-button switch and, in particular, to a push-button switch having an overload protection function and requiring a manual reset procedure before it is turned on again in case of an overload.

There are many types of push-button switches for various applications. Some comprise a turn-on indicating lamp and others provide an overload protection function. In terms of those with an overload protection function, there are also several kinds of protection principles or mechanisms being adopted. For example, either a blow-out of a fuse wire or a thermal deformation of a bimetallic blade has been adopted as a trigger condition of a switch for overload protection. However, the fuse wire has a disadvantage to reproductibility and thus its usage is gradually phased out. As for the type of switch using a thermal bimetallic blade to perform an overload protection, there have been many kinds of mechanisms proposed, such as those disclosed in U.S. Pat. Nos. 5,786,742, 5,223,813, 4,937,548, 4,661,667, 4,931,762, 5,451,729, and 4,704,594.

In the U.S. Pat. No. 5,786,742, a so-called power cutting member 72 used alternatively to set and to reset the position of a switch is disclosed. In that case, a bimetallic blade 75 is used to push a shaft seat 71 so as to trip and reset automatically a switch. However, the button of the disclosed switch directly depresses under the contact. Thus, the contacts will be kept in its conducting position as an overload is occurring if the button has jammed or pushed by an external force. Moreover, such a switch is not economical due to its use of up to four contacts, (i.e., two sets of contacts) to construct its conduct circuit. The chance of generating arc also increases. Furthermore, such a switch is troublesome to provide a wire connecting the bimetallic blade 75 with the conducting plate 74.

In U.S. Pat. No. 5,223,813, a bimetallic beam 13, a common trip 17 actuated by the bimetallic beam, and a cam member 27 are incorporated with a rocker actuator 33 to perform a contact between contact members 7 and 1. In such a switch, the common trip will be displaced in response to the deformation of the bimetallic beam so as to release the cam member and trip the switch. However, such a switch is rather complicated, even though a jamming of the rocker actuator and an accidental re-push on the switch after an overload can be avoided by virtue of an indirect actuation of its actuator to the common trip. Moreover, a connection of a wire between its cantilever spring 5 and its bimetallic beam 13 is necessary and thus its assembly is also troublesome. Furthermore, a fail-action could possibly happen due to the double-duty of the bimetallic beam to actuate both the rocker actuator 33 and the common trip 17 in case of overload.

In U.S. Pat. No. 4,937,548, a circuit breaker which utilizes the deformation of a thermal actuator 76 to displace a lock lever 62 so as to release a bell crank lever operator 52 is disclosed. In this case, a jamming of its actuator and a re-push on the switch in case of overload is avoided by virtue of an indirect actuation of the actuator to the movable contact 86. However, in such an arrangement it is inconvenient to dispose an indicating lamp. In U.S. Pat. No. 4,661,667, a push-button switch that utilizes a two-hearted-cam locking mechanism to obtain a two-platform locking system is disclosed. However, such a switch is devoid of a protection function as well as a status-indicating function.

SUMMARY OF THE INVENTION

A main object of the present invention is to provide a push-button switch having an overload protection function and a low manufacturing cost with a small simple structure ease to assemble.

Another object of this invention is to provide a push-button switch having a sufficient resiliency to perform an instant tripping function at the moment a threshold overload temperature is reached.

Yet another object of this invention is to provide a push-button switch with a simplified structure and assembly by virtue of a combination of a locking mechanism and a bimetallic sheet, To achieve the objects of this invention, the push-button switch with overload protection comprises:

a housing formed with a button hole, a stem guide, and several terminal holes;

a conducting unit including a first terminal, a second final, a first conducting leaf, and a flat bimetallic sheet;

the first and the second terminals being secured in the terminal holes respectively;

the bimetallic sheet having a movable returning end, capable of deforming from an un-deformed normal position to a deformed overload position in response to overload, and a fixed open end defined by a first leg connected to the first terminal and a second leg to be connected to the first conducting leaf; and the first conducting leaf being able to move between a closed position in which the second leg of the bimetallic sheet is electrically connected to the second terminal and a normal open position in which the second leg is disconnected from the second terminal; and an actuating unit installed in the housing and including:

a stem guided by the stem guide and slidably moving between a lower set position and a biased upper reset position a rocking lever pivotally supported on the stem along a pivoting axle and formed with a nose for depressing the first conducting leaf and a tail opposite to the nose across the pivoting axle;

an enabling rest combined with the rig end of the bimetal sheet and being able to move between a supporting position to support the tail and a withdrawing position to withdraw from the tail, in correspondence with the location of the bimetal sheet in the normal position and the overload position, respectively; and a lever reseating member for pushing the rocking lever into an idle position in which the tail could be supported by the enabling rest, during a reset course in which the stem moves from the set position to the reset position;

whereby the nose can depress and release the fit conducting leaf so as to make the latter move into the closed position and the normal-open position in response to the movement of the stem to its set position and its reset position, respectively, in case the enabling rest locates in its supporting position, and whereby the first conducting leaf can move to its normal-open position in response to a change of the bimetal sheet into its overload position, By means of the above structure, even if the stem jams, the switch can still exactly trip at the time overload occurs, and thus an exact overload protection action is obtained. Moreover, by virtue of the special structure of the bimetallic sheet, the structure of the switch can be simplified and thus a structure easy to assemble is obtainable, In the following, preferred embodiments of the present invention will be described in detail in conjunction with the accompanying drawings.

DETAILED DESCRIPTION OF THE INVENTION

Figure 1:
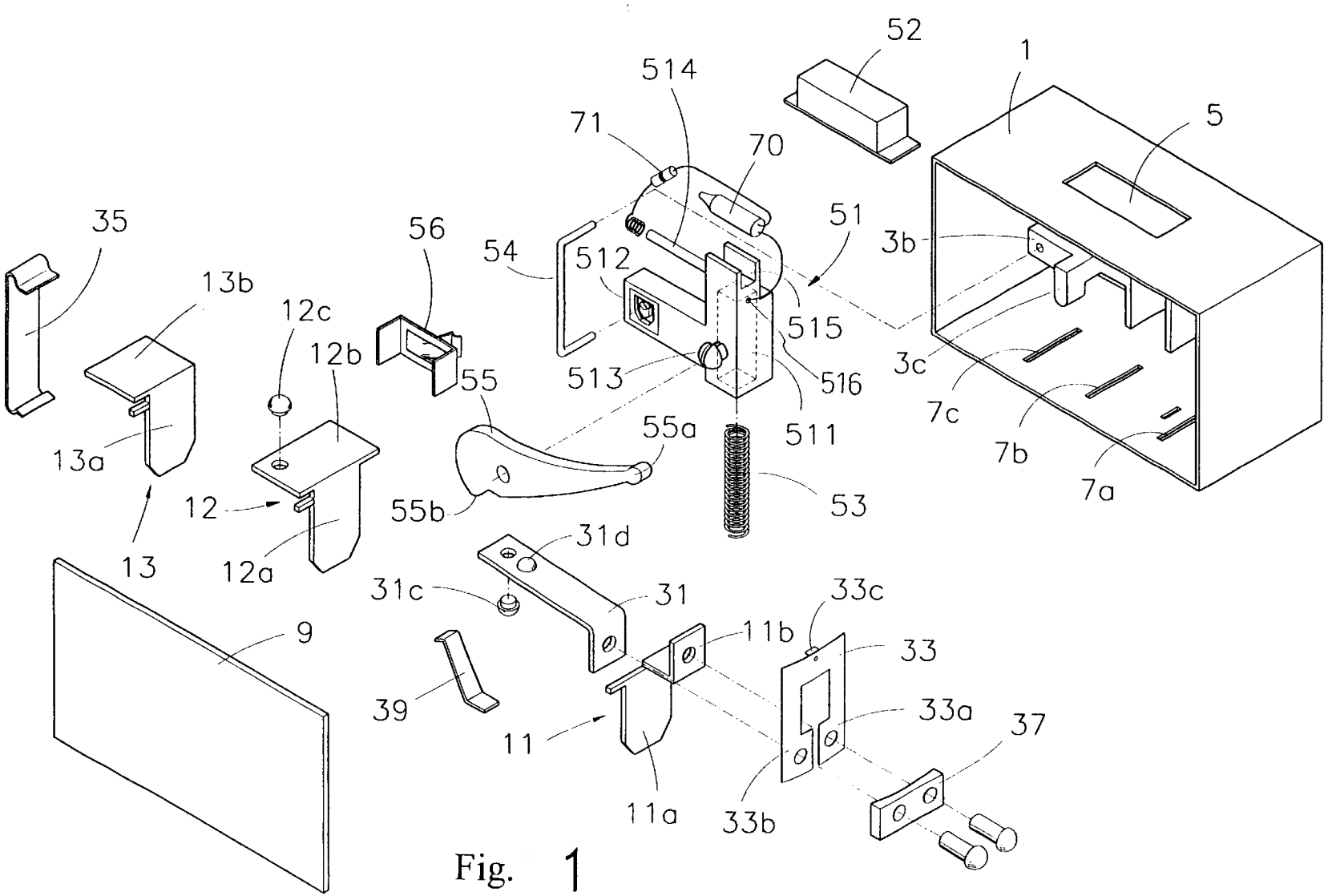
FIG. 1 is an exploded perspective schematic view of a push-button switch with overload protection according to a first embodiment of this invention.

As shown in FIG. 1 (the perspective exploded schematic view), the push-button switch with overload protection in accordance with a first embodiment of this invention generally comprises a conducting unit, an actuating unit, and a housing for receiving all the foresaid and the other elements.

The housing essentially comprises a front cover 9 and a shell 1. The shell 1 has five walls and is formed with an integrally-formed guide 3*a* therein for guiding a stem 51, a button hole 5 in a top wall, three terminal holes 7*a*, 7*b* and 7*c* in a lower wall, a cantilever holder 3*b* for receiving a cantilever 54 mentioned below, a pin 3*c* (shown in FIG. 2) for stopping against a rocking lever 55 mentioned below, a stopper 3*d* (shown in FIG. 2) for retaining the motion of a tail 55*a* of the rocking lever 55 mentioned below.

The conducting unit comprises a first terminal 11, a second terminal 12, a third terminal 13, a flat thermal-deflecting bimetal sheet 33, a second conducting leaf 35, a lamp 70, and a resistor 71. Each of the terminals 11, 12 and 13 consists of an inserting portion 11*a*, 12*a* and 13*a* to be received in its respective terminal hole 7*a*, 7*b* and 7*c*, and a tab portion 11*b*, 12*b* and 13*b* for connecting with the other elements to construct a circuit loop. The first and third terminals are connected to an external power source. A static contact 12*c* is detachably mounted in a hole formed on the tab portion 12*b* of the second terminal 12 so as to contact a movable contact 31*c* mentioned below.

Figure 4:
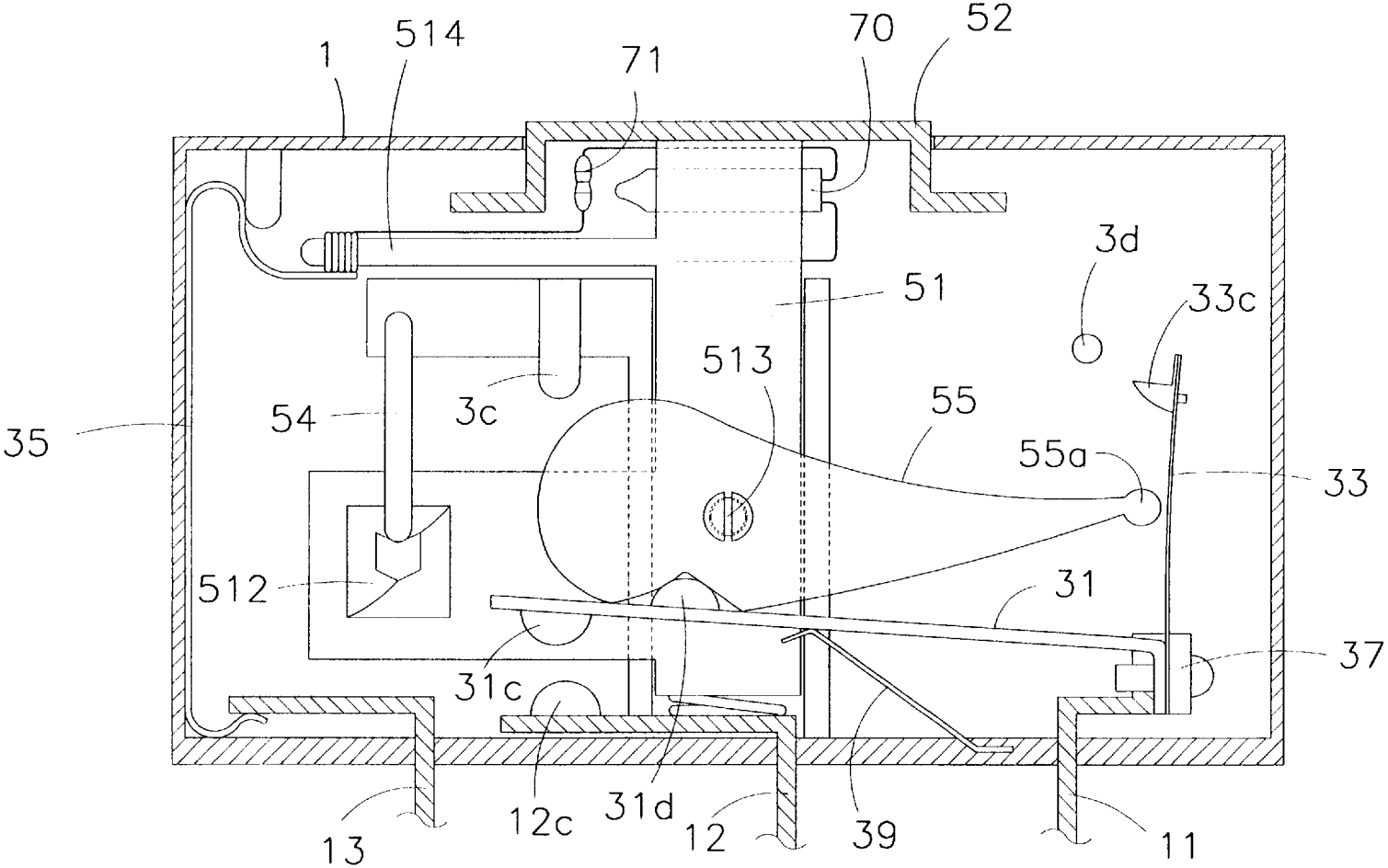
FIG. 4 is a view similar to FIG. 2 except in a tripping Status.

The bimetallic sheet 33 is of a reversed-U shape and is formed with a movable returning end and a fixed opening end consisting of two legs 33*a* and 33*b*. The two legs 33*a*, 33*b* are fixed by an insulating carrier 37 such that the surface planes of the two legs are angled. The leg 33*a* is electrically connected to the first terminal 11. By virtue of the two legs being angled, the returning end of the bimetallic sheet 33 will quickly deform to an outward-deflected overload position as shown in FIG. 4 from an un-deflected normal position as shown in FIG. 2 once the current flowing through the bimetallic sheet overloads.

Figure 2:
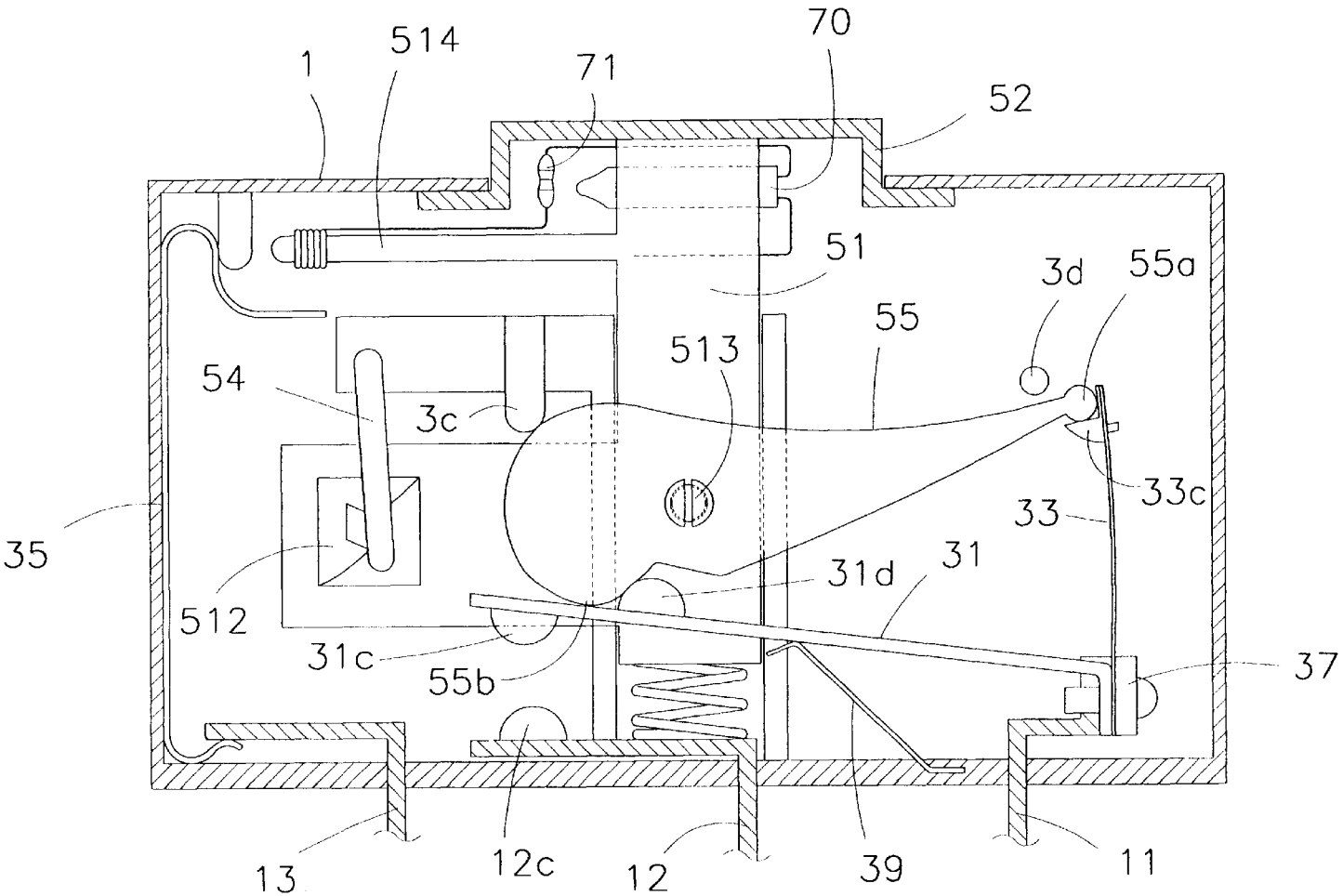
FIG. 2 is an assembled elevation view partly in section of the push-button switch of FIG. 1 in an OFF status.

The returning end of the bimetallic sheet 33, as shown in FIG. 2, is provided with an enabling rest 33*c*. The enabling rest 33*c* in this embodiment is made of a plastic material and is detachably mounted to an inner side surface of the returning end facing the rocking lever 55 via a hole formed at the returning end of the bimetallic sheet 33. The enabling rest 33*c* is provided with a platform (no number indicated) for supporting the tail 55*a* of the rocking lever 55 in a resting position and an up-tilted lower surface for guiding the tail 55*a* into the platform when the tail 55*a* returns to its resting position from a dropping position.

In an alternative selection, the carrier 37 can be omitted if the two legs could be fixed in the shell 1. For example, the leg 33*a* can be mounted to the tab portion of the first terminal 11 while the leg 33*b* can be mounted to one end of the first conducting leaf 31. Moreover, the surfaces of the two legs 33*a* and 33*b* can also be a co-planar (i.e., without slanting to each other). In such a case, the bimetallic sheet 33 will smoothly deflect to the overload position in case of overload. Furthermore, the enabling rest 33*c* can be constructed by the returning end of bimetallic sheet 33 itself and can be formed by pressing. In such a case, the platform of the enabling rest 33*c* would be formed by an edge of the returning end of the bimetallic sheet 33.

The first conducting leaf 31 is made of a flat metallic plate and has a fixed end and a free end, the fixed end being electrically connected to the leg 33*b* of the bimetal sheet 33 and being supported by the carrier 37. The free end of first conducting leaf 31 is mounted with an upper contact 31*c* and is capable of moving between a closed/conducting position in which the upper contact 31*c* and the lower static contact 12*c* contact each other and an open/cutting position in which the two contacts 31*c* and 12*c* separate from each other. The free end of first conducting leaf 31 is normally biased toward the open/cutting position by a return spring 39 and thus will normally be kept in the open position. The return spring 39 is fixed on the shell 1 at one end. In the middle portion of first conducting leaf 31, a dome 31*d* is provided on the upper surface thereof so as to be depressed by the nose 55*b* of the rocking lever 55. In an alternative option, the dome 31*d* and the return spring 39 can be omitted if the conducting leaf 35 can be in its open position normally.

The second conducting leaf 35 is used to connect the third terminal 13 with the lamp 70. One end of second conducting leaf 35 is fixed by and in conduction with the tab portion 13*b* of the third terminal 13. The other end of second conducting leaf 35 extends upwards along the side wall of the shell 1 and fixed by a post (not indicated) protruding from the top wall of the shell 1.

The acting unit comprises a stem 51 capable of vertically moving in the shell 1, a button 52 securely mounted on the top of stem 51, a coil spring 53 for biasing the stem 51 upward, a cantilever 54 for limiting the position of the stem 51, and a rocking lever 55 being pivotally supported by the stem 51 for depressing the first conducting leaf 31.

The stem 51 is provided with a body portion 511, a heart-shaped stepping recess 512 integrally formed on a side surface of the body portion 511, a snap shaft 513 integrally formed on a front side surface of body portion 511, a branch 514 integrally extending from an upper side surface of the body portion 511 , and a slot 515 formed on a top surface of the body portion 511 for receiving the lamp 70.

The body portion 511 is formed with an internal cavity (not indicated) opening downward for receiving the coil spring 53, a backward expanded protrusion to be guided by the guide by the guide 3*a*, and a hole 516 in one side wall thereof. The hole 516 allows the entrance of one leg of the lamp 70 into the cavity from the outside thereof to be connected to the second terminal 12 via the coil spring 53. The heart-shaped stepping recess 512 is of a structure like the power-cutting member 72 disclosed in the U.S. Pat. No. 5,786,742. The disclosure in such a patent is incorporated herein by reference and thus its detailed description is omitted herein. The snap shaft 513 is provided for pivotally supporting the rocking lever 55 along a pivoting axle. The branch 514 is used to carry the other leg of the lamp 70 into contact with the second conducting leaf 35 when the stem 51 is moved to its set position. Particularly, in this embodiment the other leg of the lamp 70 is connected to the second conducting leaf 35 via the resistor 71.

The button 52 is provided with a cavity facing downward to cover the lamp 70 and the slot 515. The top wall of button is preferably transparent. The coil Bug 53 is conductive and is ranged such that its upper end contacts the other leg of the lamp 70 while its lower end contacts the tab portion 12*b* of the second terminal 12, as shown in FIG. 2A The cantilever 54 is of a U-shape and has an upper hand and a lower hand. The upper hand of the cantilever 54 is pivotally inserted into a hole formed in the holder 3*b* while the lower hand is slidably inserted into the heart-shaped stepping recess 512. The lower hand of the cantilever 54 will be kept in the recess 512 by a biasing spring 56.

The rocking lever 55 is provided with a forcing hole (not indicated) as well as a tail 55*a* and a nose 55*b* respectively located at two sides of the forcing hole. The forcing hole of the rocking lever 55 can be penetrated by the snap shaft 513 so that the rocking lever 55 can pivot around and be forced by the snap shaft 513. The nose 55*b* is used to depress the dome 31*d* provided on the fist conducting leaf 31 if the stem 51 is pushed downward to its set position. The tail 55*a* functions as a supporting point for the latching lever 55 when it is supporting by the enabling rest 33*c*. That is, the nose 55*b* and the tail 55*a* are shaped and located such that the nose 55*b* will have a longer displacement in response to the displacement of the stem 51 if the tail is supported by the enabling rest 33*c*, and will have a shorter displacement in response to the displacement of the stem 51 if the tail 55*a* does not rest on the enabling rest 33*c*. Thus, the upper contact 31*c* provided on the first conducting leaf 31 will be depressed onto the lower contact 12*c* to form a closed condition or be released from the latter to form an open condition in response to the position of the tail 55*a*.

In the following, the operation of the switch having the aforementioned structure will be described. Firstly, the switch shown in FIG. 2 is considered, wherein all the elements are assembled into the shell 1 and the switch is in a normal OFF position. As shown in FIG. 2, the upper contact 31*c* separates from the lower contact 12*c* and thus the first conducting leaf 31 is in an open position; the upper end of second conducting leaf 35 separates from the leg of the resistor 71 and thus the lamp 70 cannot emit light; the lower hand of the cantilever 54 is located at a lower end of the heart-shaped stepping recess 512 and thus the stem 51 is in a reset position; the tail 55*a* of the rocking lever 55 rests on the enabling rest 33*c* and thus the rocking lever 55 is in an enabled and idle position.

Figure 3:
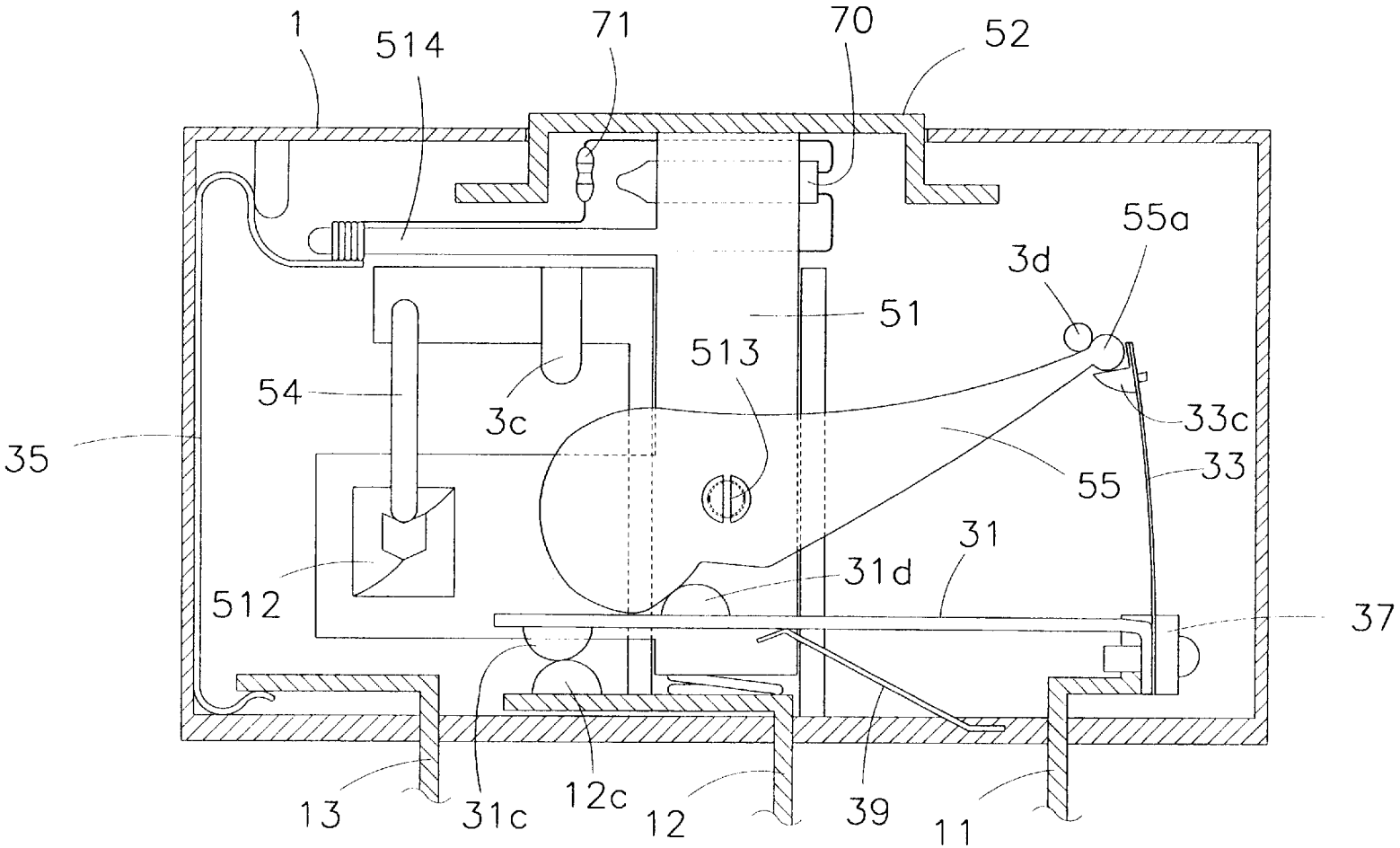
FIG. 3 is a view similar to FIG. 2 except in an ON status.

If the button 52 is depressed downward so as to switch the switch into an ON status, as shown in FIG. 3, the stem 51 will move downward and the lower hand of the cantilever 54 simultaneously slides into an upper notch of the heart-shaped stepping recess 512 so as to limit the stem 51 in its set position. In the meanwhile, the nose 55*b* moves downward to depress the dome 31*d* of the first conducting leaf 31, by virtue of the fact that the tail 55*a* is kept in its original resting position by the enabling rest 33*c*. Thus, the upper contact 31*c* provided on the first conducting leaf 31 will be pressed down and then come into contact with the lower contact 12*c* provided on the second terminal 12. An ON status between the first and the second terminals 11 and 12 via the bimetallic sheet 33 and the first conducting leaf 33 is obtained. On the other hand, the upper end of the second conducting leaf 35 also contacts the leg of the resistor 71 and thus an ON status between the second and the third terminals 12 and 13 via the second conducting leaf 35, the resistor 71, the lamp 70, and the coil spring 53 is also obtained. Meanwhile, the lamp 70 emits light indicating the ON status.

During the ON status, if the current flowing through the switch is overload, as shown in FIG. 4, the bimetallic sheet 33 will deflect, when a certain temperature threshold is reached, to a deflected overload position in which the enabling rest 33*c* is shifted away from the tail 55*a* of the rocking lever 35. In such a situation, the tail 55*a* of the rocking lever 55 will drop down and the nose 53*b* will release the first conducting leaf 31 due to the tail 55*b* failing to be supported by the enabling rest 33*c*. Thus, the first conducting leaf 31 changes into an open position in which the upper contact 31*c* separates from the lower contact 12*c* and the current between the first and the second terminals 11 and 12 is cut. At the same time, the lamp 70 stops emitting light. The switch is therefore tripped and the stem 51 is still positioned in the set position, In such a tripped status, the switch cannot be changed to an ON status in case the bimetallic sheet 33 fails to return to its normal position or the stem 51 fairs to be reset to its reset position. Once the bimetallic sheet 33 returns to its normal position and the stem 51 is reset to its reset position, the switch is completely reset to its OFF status and an ON status could thus be set once again. In detail, if the bimetallic sheet 33 fails to return to its normal position, the tail 55*a* could not be supported by the enabling rest 33*c* and thus the nose 55*b* could not sufficiently depress the first conducting leaf 31 even though the stem 51 is reset to its upper reset position. However, if the bimetallic sheet 33 has returned to its normal position, the tail 55*a* of the rocking lever 55 will move into it resting position, in line with the reset/raising of the stem 51, and be supported by the enabling rest 33*c*. The tail 55*a* can also move into its resting position after the bimetallic sheet 33 returns to its normal position, because the enabling rest 33*c* is provided with an oblique lower surface.

On the other hand, if the switch is to be turned-off during the ON status in which not overload happens, depressing the stein 51 could make the switch return to its OFF status. Such a course is similar to the process of resetting the stem 51 in case the bimetallic sheet 33 has returned to its normal position after a tripping. That is, in line with depressing the stem 51, the lower hand of cantilever 54 will escape from the upper notch of the heart-shaped stepping recess 512 and the stem 51 is permitted to raise to its reset position under the action of the coil spring 53. The first conducting leaf 31 is then located in an open position and the leg of resistor 71 along with the branch 514 separates from the second conducting leaf 35. Thus, the second terminal 12 is cut away from the first and the third terminals 11, 13 and the switch is reset to a complete OFF sot as shown in FIG. 2.

By means of the aforementioned structure, the switch disclosed in this invention is provided with an overload protection feature and has a low-cost and simple structure with easy assembly. Moreover, it is comprehensible that the omission of the third terminal, the second conducting leaf 35, the resistor 71, and the lamp 70 would not affect the overload protection function.

Figure 5:
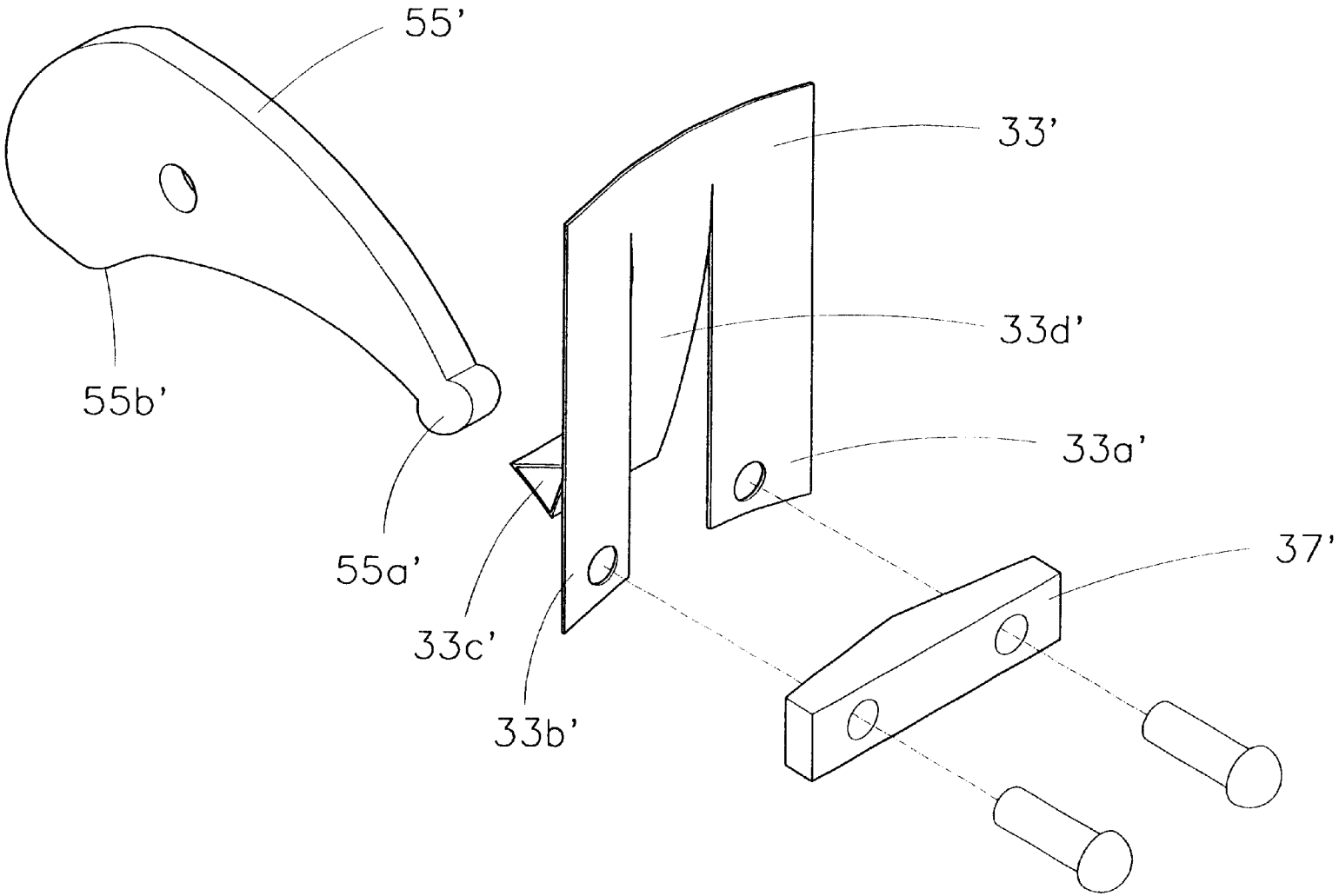
FIG. 5 is a perspective view of an alternative design for the bimetallic sheet and the rocking lever disclosed in the first embodiment of this invention.

FIG. 5 depicts a partial perspective view with respect to an alternative design of the embodiment shown in FIG. 1, being different in the structure of the rocking lever 55' and the bimetallic sheet 33'. To prevent confusion, the indicated numbers used in the alternative design are the same as those in the first embodiment except that a symbol ' is attached.

As shown in FIG. 5, the rocking lever 55' is also provided with a nose 55*b*' and a tail 55*a*'. Moreover, the enabling rest 33*c*' of the bimetallic sheet 33' is cut from and integrally formed with the bimetal sheet 33' and comprises an arm portion 33*d*' extending from the returning end of the bimetal sheet 33', an oblique lower portion extending from the arm portion 33*d*', and a platform portion extending from the oblique lower portion. Furthermore, the direction in which two legs 33*a*' and 33*b*' are angled is opposite to that in the first embodiment In such an arrangement, the enabling rest 33*c*' will move to one side of standing off the rocking lever 55' with respect to the bimetallic sheet 33', as shown in FIG. 7, from one side nearing the rocking lever 55', as shown in FIG. 6, in case the bimetallic sheet 33' deflects to its overload position upon overload.

The operation of the alternative design shown in FIG. 5, such as the setting, tripping, or resetting, is fundamentally the same as those in the first embodiment and thus only an ON status and a tripping status thereof are representatively shown by FIGS. 6 and 7 respectively and briefly described in the following. As shown in FIG. 6, in an ON status, the tail 55*a*' of the rocking lever 55' is supported by the enabling rest 33*c*' and thus the nose 55*b*' thereof is capable of depressing the dome 31*d*' of the first conducting leaf 31', along with a downward motion of the stem 51', so as to urge the first conducting leaf 31' into a closed position, thereby obtaining a contact between the upper contact 31*c*' and the lower contact 12*c*'.

Figure 6:
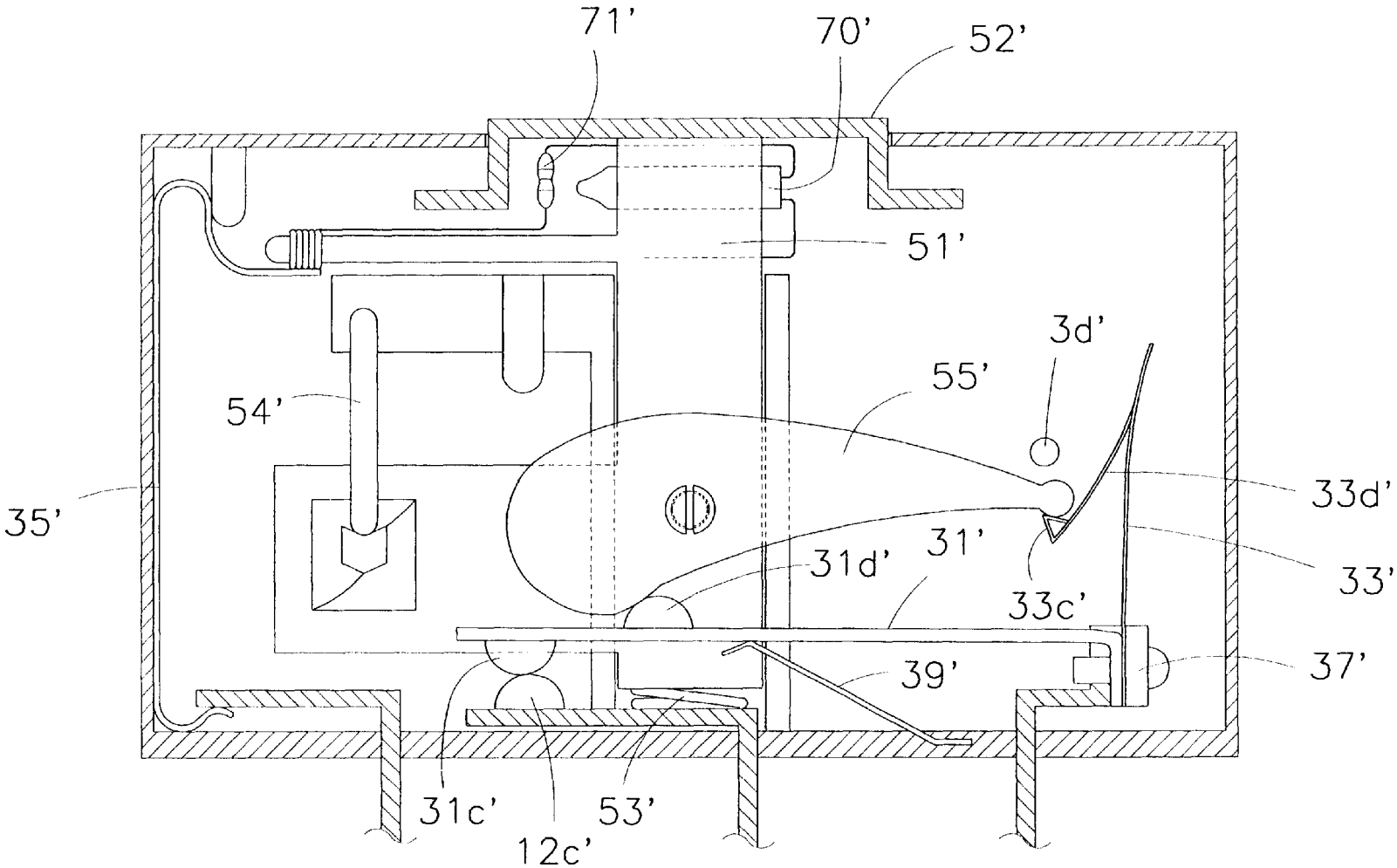
FIG. 6 is an assembled elevation view partly in section of the push-button switch of FIG. 5 in an ON status.
Figure 7:
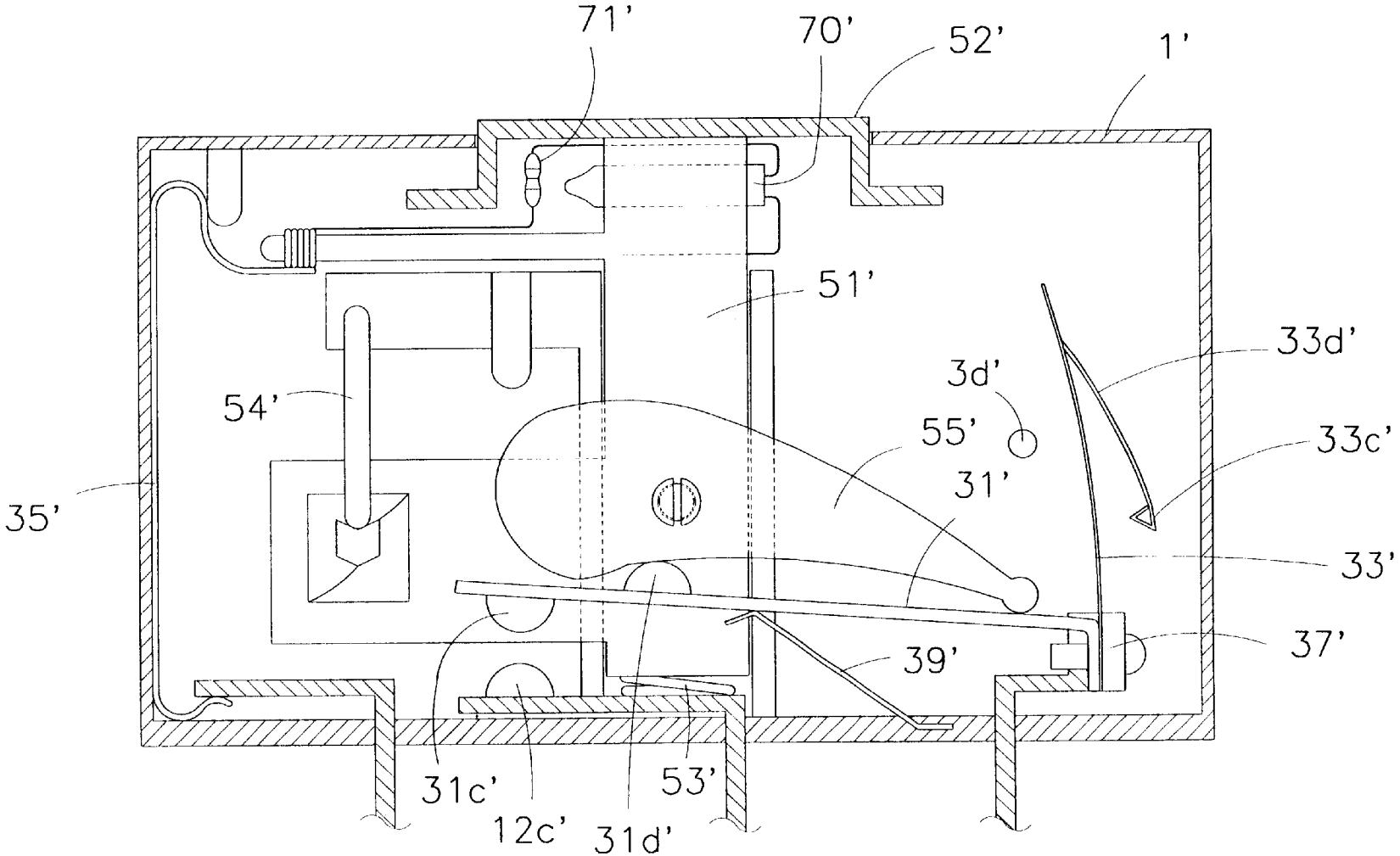
FIG. 7 is a view similar to FIG. 6 except in a tripping status.

In case the switch shown in FIG. 6 comes into overload, as shown in FIG. 7, the enabling rest 33*c*' will be moved to a withdrawing position located on the side standing off the rocking lever 55' with respect to the bimetallic sheet 33'; the rocking lever 55' will be rotated clockwise by the dome 31*d*' under the action of the return spring 39' and thus the tail 55' will be moved to a dropping position while the f conducting leaf 31' moves to its open position.

FIGS. 8 to 13 depict a second embodiment of the switch according to this invention. To prevent confusion, the indicated numbers used in the second embodiment are the same as those in the first embodiment except that a symbol " is attached.

Figure 8:
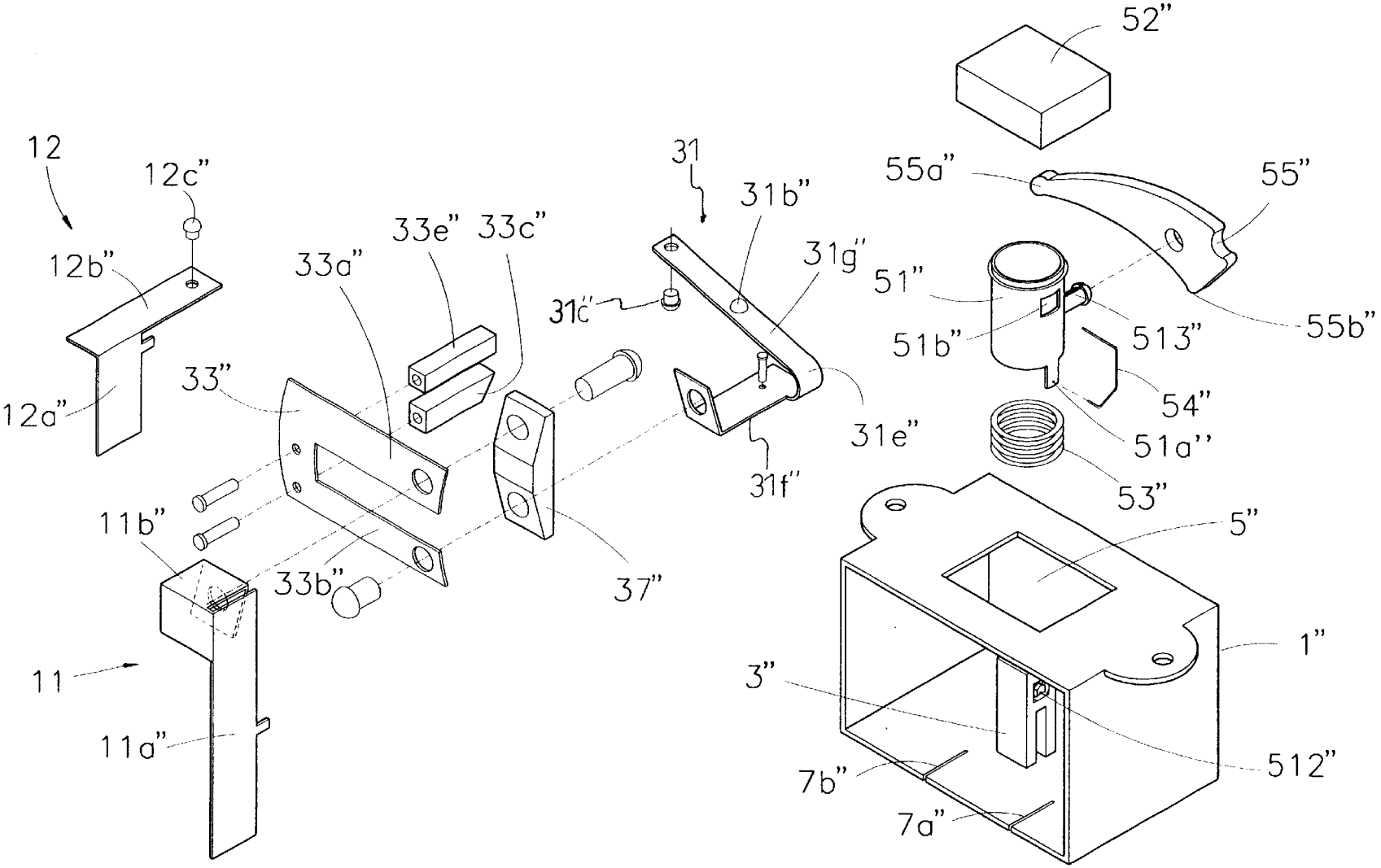
FIG. 8 is an exploded perspective schematic view of a push-button is switch with overload protection according to a second embodiment of this invention.

As shown in FIG. 8, the push-button switch with an overload protection in accordance with the second embodiment of this invention also comprises a terminal unit, a conducting unit, an actuating unit, a lamp 70, and a housing for receiving all the aforesaid elements.

The housing essentially comprises a front cover 9 and a shell 1 having five walls and being provided with an integer-formed post 3" for guiding a stem 51", a button hole 5" in the top wall thereof for a protrusion of a button 52", two terminal holes 7*a*", 7*b*" in a bottom wall thereof for receiving terminals, and a pin 3*c* (shown in FIG. 9) integrally formed therein for stopping a rocking lever 55".

The conducting unit comprises a conducting leaf 31", a flat thermal-deflecting bimetallic sheet 33", a first terminal 11", and a second terminal 12". Both the terminals 11" and 12" are used to connect with an external power source. Each of the terminals 11" and 12" is consisted of an inserting portion 11*a*" and 12*a*" to be received in a respective terminal hole 7*a*" and 7*b*" and a tab portion 11*b*" and 12*b*" for connecting with the other conducting elements to construct a circuit loop. A static contact 12*c* is detachably mounted in a hole formed in the tab potion 12*b*" of the second terminal 12" so as to contact a movable contact 31*c*" mentioned below.

Figure 10:
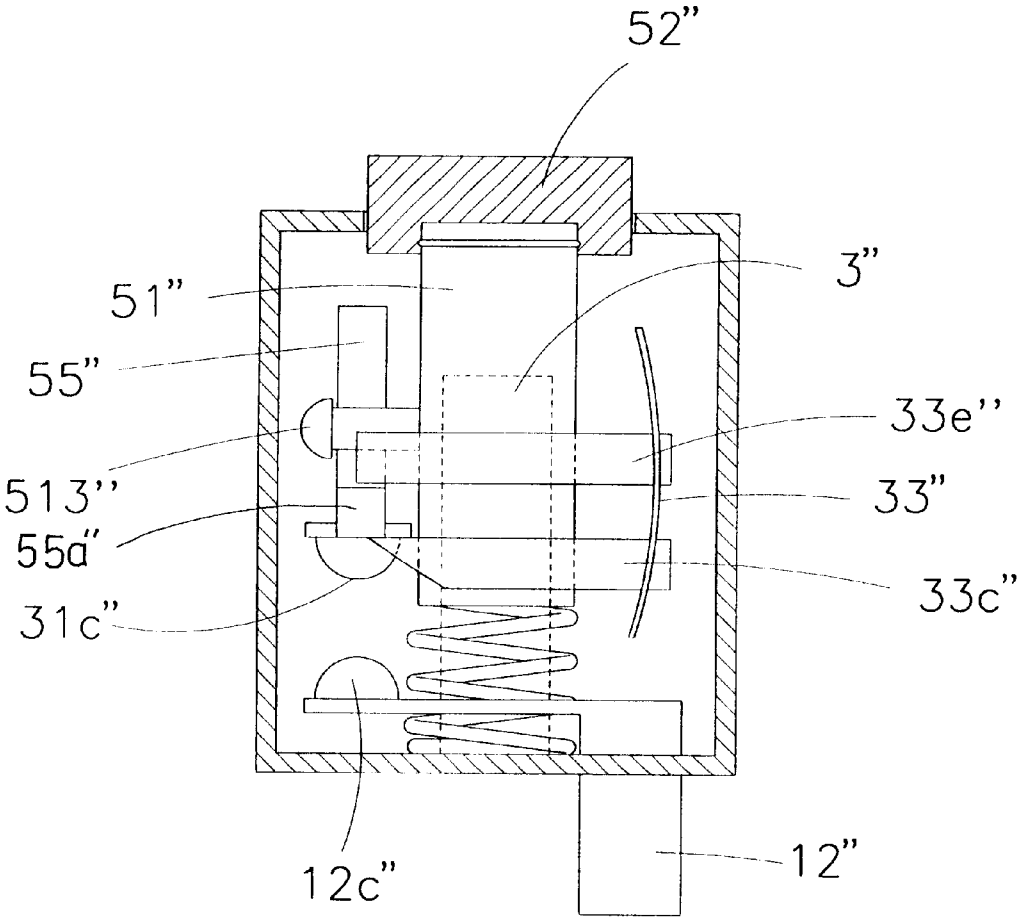
FIG. 10 is a side view partly in section taking along section 10—10 of FIG. 9.
Figure 13:
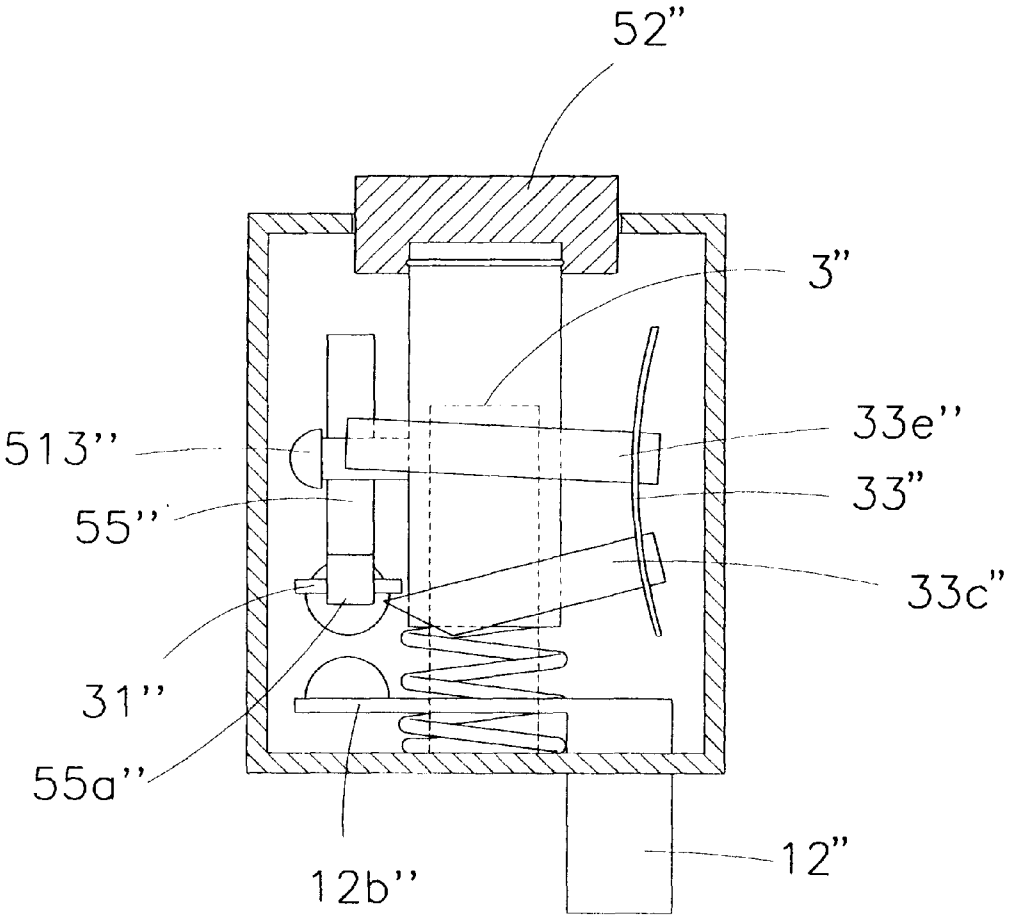
FIG. 13 is a side view partly in section taken along section 13—13 of FIG. 12.

The bimetallic sheet 33" is of a U shape having two legs 33*a*" and 33*b*" and a returning end. The returning end functions as a movable working end. The two legs 33*a*" and 33*b*" are fixed by an insulating carrier 37" such that each surface of the leg 33*a*" and 33*b*" is backward angled. The leg 33*a*" is electrically connected to the first terminal 11". By virtue of the two legs 33*a*" and 33*b*" being angled, identical to the situation in the first embodiment, the returning end of the bimetallic sheet 33" will be quickly deformed to a forward-curved overload position as shown in FIG. 13 from a backward curved normal position as shown in FIG. 10 in case the current flowing through the bimetallic sheet 33 comes into overload.

The ruing end of the bimetallic sheet 33", as shown in FIG. 8, is provided with an enabling rest 33*c*" and a stopper 33*e*". The enabling rest 33*c*" and the stopper 33*e*" in this embodiment are made of plastic material and are detachably mounted to an inner side surface of the returning end facing the rocking lever 55 via holes formed at the returning end of bimetallic sheet 33". The upper side surface of enabling rest 33*c* serves as a platform for supporting the tail 55*a*" of the rocking lever 55" in a rest position, and the lower side surface thereof is provided wit a up-tilted lower surface at its free end for guiding the tail 55*a*" into the upper side surface when the tail 55*a*' is returning to its resting position from a dropping position.

The conducting leaf 31" is made by a flat metallic plate and has a fixed portion and a movable portion. The fixed portion of the conducting leaf 31" is provided with a fixed end being electrically connected to one leg 33*b*" of the bimetallic sheet 33" and supported by the carrier 37", and a shifting portion 31*f*" to sift the movable portion backward away from the fixed end. The movable portion of conducting leaf 31" is provided with a leaf portion 31*g*" and a bow portion 31*e*" which produces an up-moving resilient force on the leaf portion 31*g*" thereof. The leaf portion 31*g*" is provided with a dome 31*b*" in the middle for bearing the depression of the nose 55" and an upper contact 31*c*" near the See end to electrically contact the lower contact 12*c*".

The actuating unit comprises a stem 51" of a cylindrical shape, a heart-shaped stepping recess 512" provided on the post 3", a button 52" to securely mounted on the top of stem 51", a coil spring 53" for biasing the stem 51" upward, a cantilever 54" for limiting the position of the stem 51", and an rocking lever 55" being pivotally supported by the stem 51" for depressing the conducting leaf 31".

The stem 51" is guided by the post 3" and has a lower first hole 51*a*" for receiving a lower hand of cantilever 54", an upper second hole 51*b*" for the pass of an upper hand of cantilever 54" from the outside of the stem 51" to the heart-shaped stepping recess 512", and a snap shaft 513" integrally extended from a rear surface thereof for supporting the rocking lever 55".

The coil spring 53" has an upper end which can be combined with the lower end of the stem 51" by any suitable manner, and a lower end resting on the bottom wall of the shell 1". The heart-shaped stepping recess 512" provided in the post 3" is similar to that in the first embodiment except that a notch (not indicated) is provided at a lower end thereof. The cantilever 54" serves the same function as that in the first embodiment except that the hand to be inserted into the heart-shaped stepping recess 512" is the upper hand.

The rocking lever 55" is also provided with an over-center forcing hole (not indicated)-and a tail 55*a*" and a nose 55*b*" respectively located on two sides of the forcing hole, each of them having a functions like that in the first embodiment except with different shapes and locations.

Figure 9:
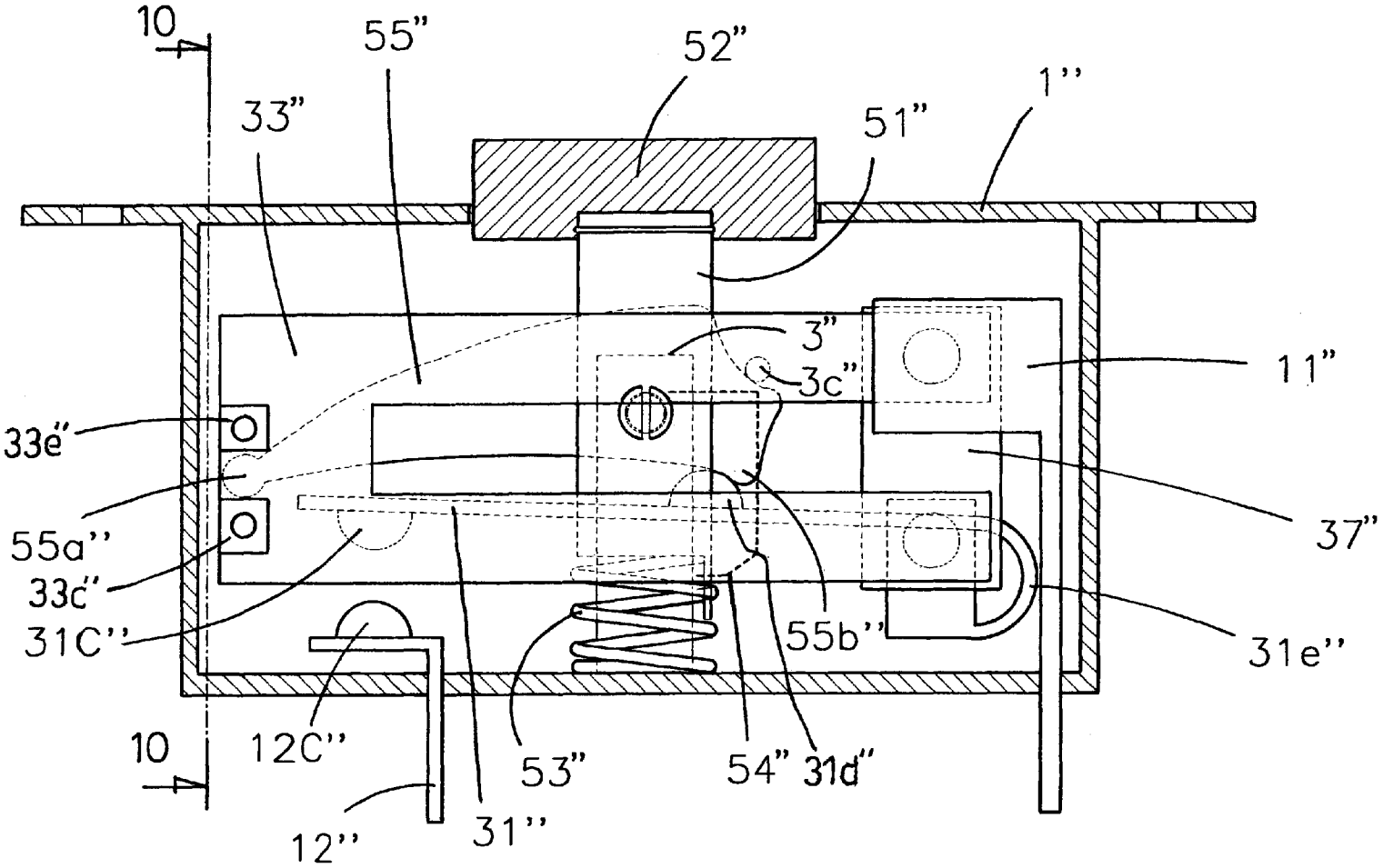
FIG. 9 is an assembled elevation view partly in section of the push-button switch of FIG. 8 in an OFF status.

FIG. 9 shows a front view, partly in section, of the switch according to the second embodiment of this invention in an OFF position. As shown in FIG. 9, referring to FIG. 10, the stem 51" is in an upper reset position; the bimetallic sheet 33" is in a backward-curved normal position; the tail 55*a*" is received in the gap formed between the enabling rest 33*c*" and the stopper 33*e*"; the nose 55*b*" is in a contact with the dome 31*d*"; and the conducting leaf 31" is in an open position in which the upper contact 31*c*" separates from the lower contact 12*c*".

Figure 11:
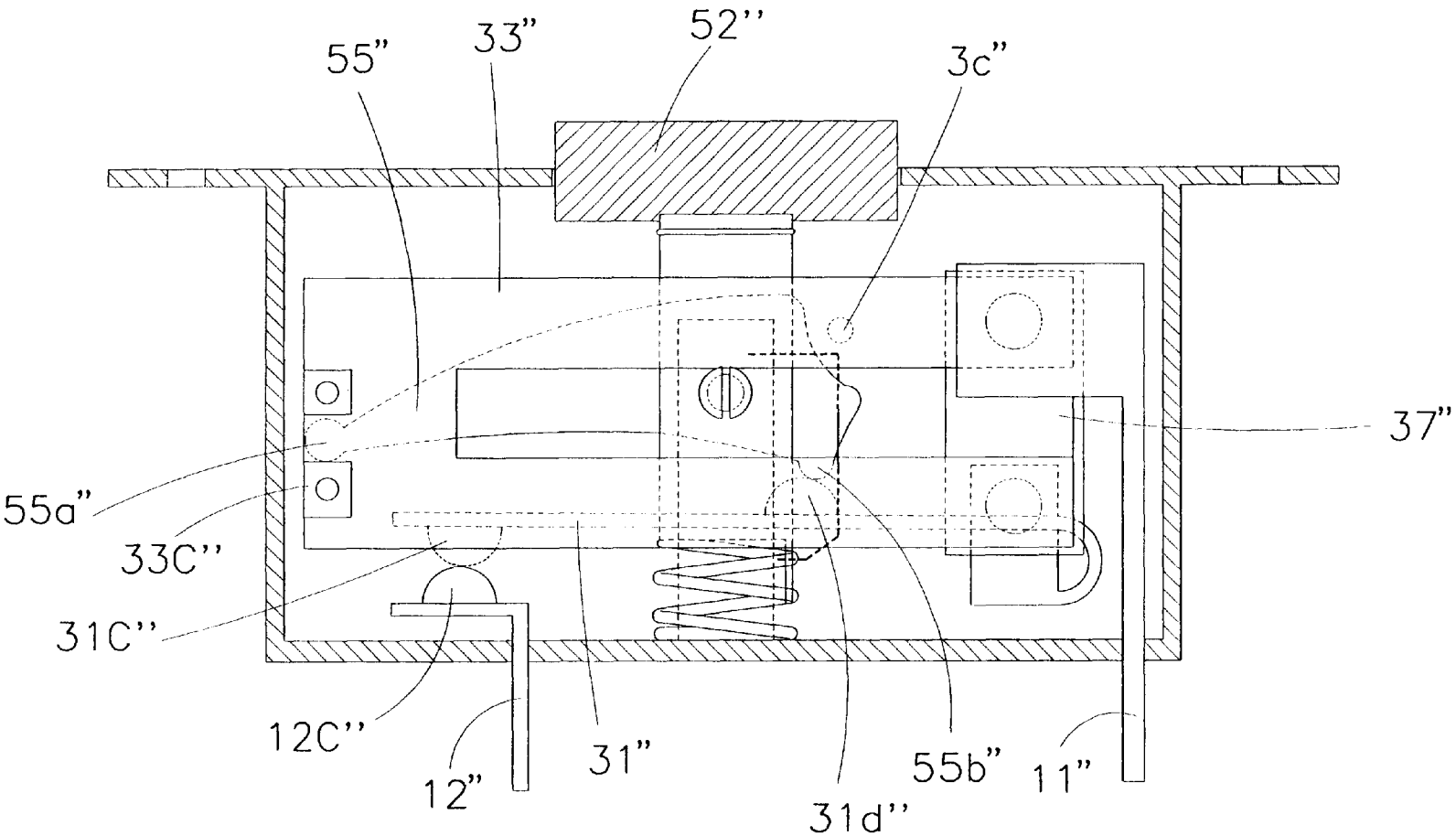
FIG. 11 is a view similar to FIG. 9 except in an ON status.

In case the switch of the second embodiment is changed from its to OFF position to its ON position, as shown in FIG. 11, the dome 31*d*" will be depressed downward by the nose 55*b*" and the conducting leaf 31" will be in a closed position and the upper contact 31*c*" will be in a contact with the lower contact 12*c*".

Figure 12:
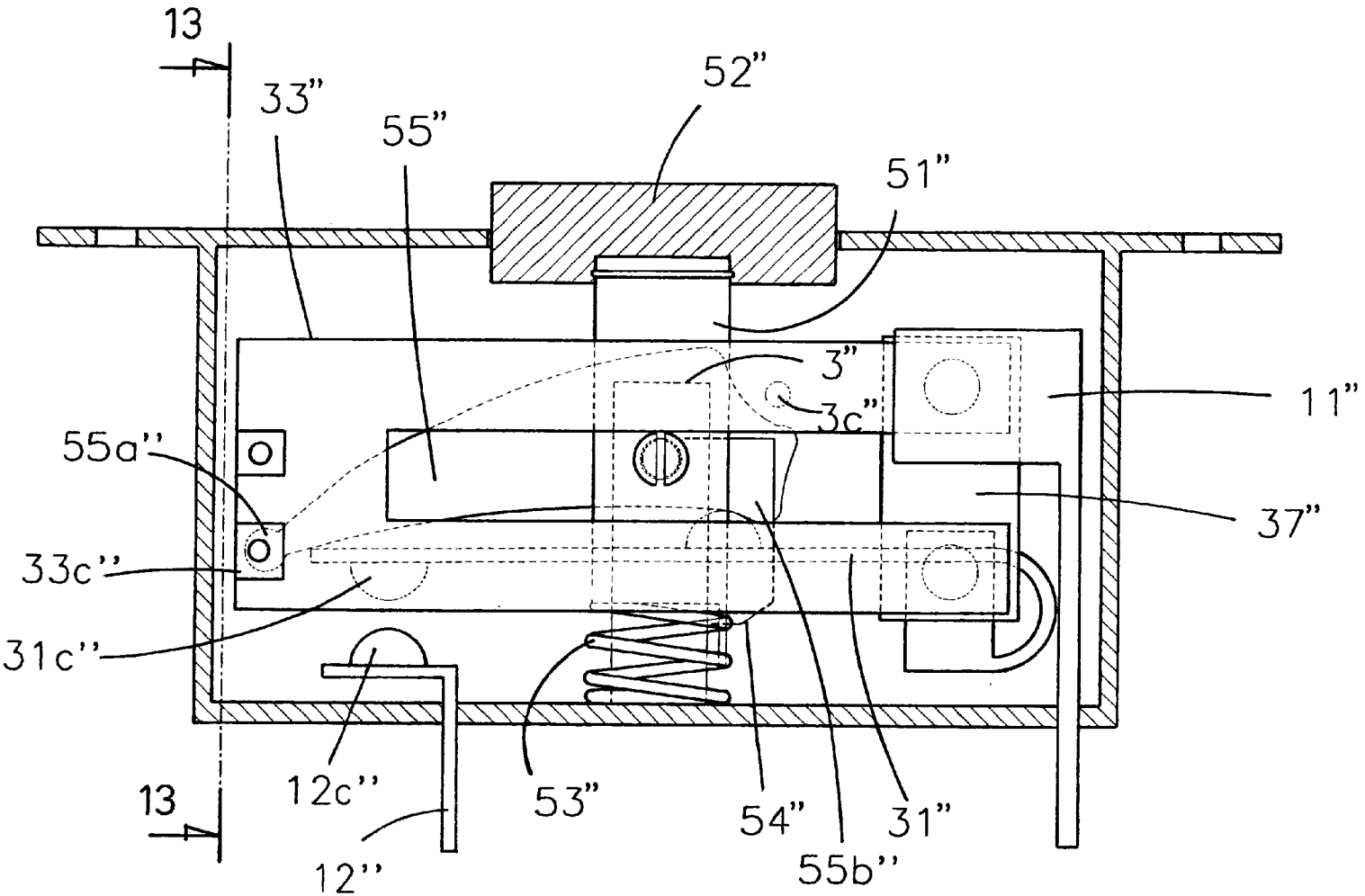
FIG. 12 is a view similar to FIG. 9 except in a tripping status.

The case of the Etch of the second embodiment being tripped is under an overload condition is shown in FIG. 12. As shown in FIG. 12, referring to FIG. 13, the bimetallic sheet 33" is of a forward-curved deflecting position in which the enabling rest 3 3*c*" and the stopper 33*e*" divergently separate and thus the enabling rest 55*a*" is not supported. Due to the resiliency of the conducting leaf 31" itself and a lever function on the nose 55*b*", the rocking lever 55" will rotate counterclockwise until the free end of the conducting leaf 31" is engaged.

The reset procedure and principle after tripping is similar to that in the first embodiment. For example, the transition of the switch from its tripped status to its OFF status can be performed either after or before the bimetallic sheet 33" returns to its normal position. The return of the rocking lever 55" to its rest position is brought about by the raising of the stem 51" to its reset position and the engagement of the pin 3 *c*" against the rocking lever.

According to the above embodiments, it is conceivable that the switch of this invention comprises three modes (i.e., OFF, ON, tripping status) and two positions (i.e., set and reset positions), and that a reset procedure should be done once a tripping status occurs. Moreover, since the enabling rest is directly disposed on the returning end of U-shaped bimetallic sheet, and since the bimetallic sheet can be quickly deformed, a pitch which is space-saving and low cost and having a simple construction, definite action and status indication is thus available.

While the present invention is described by way of preferred embodiments, it should be understood that the embodiments are used only to illustrate the technical concept of the present invention without limiting the scope thereof. It is therefore intended that all modifications and alterations that are readily apparent to those skilled in the art are within the scope as defined in the appended claims.

What is claimed is:

1. A push-button switch with overload protection comprising:

a housing formed with a button hole, a stem guide, and several terminal holes;

a conducting unit including a first terminal, a second terminal, a first conducting leaf, and a flat bimetallic sheet;

the first and the second terminals being secured in the terminal holes respectively;

the bimetallic sheet having a movable returning end, capable of deforming from an un-deformed normal position to a deformed overload position in response to overload, and a fixed open end defined by a first leg connected to the first terminal and a second leg to be connected to the first conducting leaf; and the first conducting leaf being able to move between a closed position in which the second leg of the bimetallic sheet is electrically connected to the second terminal and a normal open position in which the second leg is disconnected from the second terminal; and an actuating unit installed in the housing and including:

a stem guided by the stem guide and slidably moving between a lower set position and a biased upper reset position;

a rocking lever pivotally supported on the stem along a pivoting axle and formed with a nose for depressing the first conducting leaf and a tail opposite to the nose across the pivoting axle;

an enabling rest combined with the returning end of the bimetal sheet and being able to move between a supporting position to support the tail and a withdrawing position to withdraw from the tail, in correspondence with the location of the bimetal sheet in the normal position and the overload position, respectively; and a lever reseating member for pushing the rocking lever into an idle position in which the tail can be supported by the enabling rest;

during a reset course in which the stem moves from the set position to the reset position;

whereby the nose can depress and release the first conducting leaf so as to make the latter move into the closed position and the normal-open position in response to the movement of the stem to its set position and its reset position, respectively, in case the enabling rest locates in its supporting position, and whereby the first conducting leaf can move to its normal-open position in response to a change of the bimetal sheet into its overload position.

2. The switch according to claim 1, wherein the actuating unit further comprises a heart-shaped stepping recess integrally formed on the stem and a cantilever having two hands at its two end respectively, one hand of the cantilever being pivotally mounted on the housing and the other hand movably inserted into the heart-shaped stepping recess.

3. The switch according to claim 1, wherein the stem guide is in the form of a post, the stem is in the form of a cylinder; and wherein the actuating unit fixer comprises a cantilever having two hands at its two ends respectively, and a heart-shaped stepping recess formed on one side of the post; the stem being provided with a first hole for pivotally receiving one hand of the cantilever and a second hole for the pass of the other hand of the cantilever from the outside of the stem to the heart-shaped stepping recess.

4. The switch according to claim 1, wherein the bimetallic sheet is of a reversed-U shape, and each of the first and the second legs has a surface plane, the two surface planes of the two legs being angled so that the returning end of the bimetal sheet snap changes from the normal position to the overload position upon overload.

5. The switch according to claim 1, wherein the enabling rest is provided with a platform for supporting the tail and an oblique lower surface for guiding the tail into the platform.

6. The switch according to clam 1, wherein the enabling rest is detachably mounted on the returning end of the bimetallic sheet.

7. The switch according to claim 1, wherein the enabling rest is integrally form with the returning end of the bimetal sheet and comprises an arm portion extending from the returning end of the bimetallic she an oblique lower portion extending from the arm portion, and a platform portion extending from the oblique lower portion.

8. The switch according to claim 1, wherein the conducting unit flier comprising a third terminal mounted in one of the terminal holes;

a lamp having a first pin and a second pin for connecting with the second and the third terminals, respectively, a second conducting leaf having one end connecting with the third terminal;

and wherein the stem further comprises a branch extending therefrom for carrying the first pin of the lamp into conduction with the other end of the second conducing leaf.

9. The switch according to claim 8, wherein the actuating unit further comprises a spring for biasing the stem upward and for connecting the second pin of the lamp with the second terminal.

* * * * *